US005237835A

United States Patent [19]

Brochier

[11] Patent Number: 5,237,835

[45] Date of Patent: Aug. 24, 1993

[54] INSTALLATION PERMITTING THE RAPID CHILLING (OR HEATING) OF PACKAGED PRODUCTS, IN PARTICULAR OF BOTTLES

[75] Inventor: Yves Brochier, Vaucluse, France

[73] Assignee: Construction Metalliques Ardechoices C.M.A., France

[21] Appl. No.: 679,112

[22] Filed: Apr. 2, 1991

[30] Foreign Application Priority Data

Apr. 5, 1990 [FR] France ..... 90 04625

[51] Int. Cl.[5] ..... F25D 17/02; F25D 25/00

[52] U.S. Cl. ..... 62/376; 62/63; 62/64; 62/336; 62/373; 62/374; 62/378

[58] Field of Search ..... 62/64, 378, 63, 373, 62/374, 336, 376; 432/241

[56] References Cited

U.S. PATENT DOCUMENTS

| | | | |
|---|---|---|---|
| 2,061,427 | 11/1936 | King . | |
| 2,422,350 | 6/1947 | Gross | 62/378 X |
| 4,541,251 | 9/1985 | Louradour et al. | 62/64 |
| 4,637,226 | 1/1987 | Sitte | 62/64 X |
| 4,715,195 | 12/1987 | Kucza | 62/378 X |
| 4,828,490 | 5/1989 | Indig | 432/241 X |
| 4,920,763 | 5/1990 | Provest et al. | 62/378 |
| 4,976,613 | 12/1990 | Watanabe | 432/241 |

FOREIGN PATENT DOCUMENTS

| | | | |
|---|---|---|---|
| 0347286 | 7/1989 | European Pat. Off. . | |
| 285521 | 3/1914 | Fed. Rep. of Germany . | |
| 0137147 | 10/1979 | Japan | 62/64 |
| 8803251 | 6/1988 | PCT Int'l Appl. . | |

*Primary Examiner*—Henry A. Bennett
*Assistant Examiner*—Christopher Kilner
*Attorney, Agent, or Firm*—Wall and Roehrig

[57] ABSTRACT

Installation permitting the rapid chilling of products stored, in particular, inside a bottle (5), consisting of a tank (1) arranged within an insulating chamber, and which contains a liquid (3) maintained at very low temperature by means of a chilling circuit (2), the products (5) to be cooled being held in the chilling medium by means of pockets (4) which descend into the chilling fluid and inside which are arranged the products to be cooled. It is defined in that the pocket or pockets (4) is or are in the form of an envelope open at its upper part (6) with a base consisting of a flexible, leaktight plastic film, and retained along their open zone at the upper part (7) of the chamber (1), and the closed base (8) of which is associated with means enabling it to be displaced from the open upper part (6) to a position near the bottom (9) of the chamber, and vice versa.

5 Claims, 3 Drawing Sheets

INSTALLATION PERMITTING THE RAPID CHILLING (OR HEATING) OF PACKAGED PRODUCTS, IN PARTICULAR OF BOTTLES

BACKGROUND OF THE INVENTION

The present invention relates to an improvement made to installations permitting the rapid cooling, and even freezing (or conversely heating), of various products, in particular of liquids such as drinks stored in bottles. In the description which follows, the invention will be described in the case of the treatment of liquids stored in bottles, but it is clear that no limitation is implied and that the installation according to the invention could be used for products stored in other forms (for example in the form of bags, metal boxes or cartons), or even for solid products.

In the field of the rapid cooling of various products, it is well known that best results are obtained by immersing the products to be cooled directly in the medium, for example directly in a very cold brine or melting ice, as is disclosed, in particular, in WO-A-88 03251 (corresponding to U.S. Pat. No. 4,920,763) or U.S. Pat. No. 2,422,350.

Although such a technique gives satisfactory results, it is clear that the contact between the product and the cooling medium has disadvantages, in particular in the case of foodstuffs. As a result, it was proposed a long time ago to envelop the product to be cooled with a thin protective film. All that remains to be said about this proposal is that, even with such a protection, in particular when the cooling fluid is a liquid, such a solution is not entirely satisfactory.

In order to obtain a rapid cooling, it was also proposed a long time ago, in particular in patent U.S. Pat. No. 2,061,427, to use chilling units comprising pockets (or the like) which descend into the chilling fluid and which are intended to contain bottles enclosing the liquid to be cooled. Such units have the advantage of being able to effect a rapid cooling of the bottles and of preventing the fluid from making their surface wet. In order to obtain a good efficiency, it is, however, necessary to have a good contact between the surface of the bottles and the envelope, which therefore entails either always using the same bottles for an envelope of given shape or, as described in the abovementioned document, having an extensible envelope (made from rubber) of a relatively complex structure since, in order to have good heat exchange, this entails the provision of metal inserts. Furthermore, even with such an extensible envelope, it is clear that the range of products which can be treated is limited, and that the envelope will not be applied correctly to the surface of an object having a shape other than cylindrical. Even though such an envelope can be expanded by virtue of the extensibility of the material of which it is composed, nevertheless it will not be applied against the surface of elements which have dimensions less than its nominal diameter. Lastly, the upper part of the bottle is not in contact with the wall of the envelope and it may be awkward to place and remove it since it must be introduced "by force" if it has a diameter corresponding substantially to the diameter of the envelope, whereas in the case of small bottles, as mentioned above, the envelope will not be applied against the periphery and, in addition, this will entail the placing and removal of the bottle by hand by thrusting one's hand into the envelope.

Not only does the invention make it possible to overcome the abovementioned problems but it also makes it possible to overcome a problem which has not been posed or overcome hitherto, which is that of being able to produce a unit permitting a programed period of heat exchange and not requiring any monitoring on the part of the user.

SUMMARY OF THE INVENTION

In general manner, the invention therefore relates to an improvement made to installations permitting rapid cooling of various products stored, in particular, inside a bottle, of a type consisting of a tank, arranged within an insulating chamber, and which contains a liquid maintained at a very low temperature by means of a chilling circuit, the products to be cooled being held in the chilling medium by means of "pockets" which descend into the chilling fluid and inside which are arranged the products to be cooled, and it is defined in that the pocket or pockets is or are in the form of an envelope open at its upper part, with a base consisting of a flexible leaktight plastic film, and retained along their open zone at the upper part of the chamber, and the closed base of which is associated with means enabling it to be displaced from the open upper part to a position near the bottom of the chamber, and vice versa.

By virtue of such an embodiment, the placing and removal of the bottles to be cooled can take place not only in a very simple manner since, in the upper position, the pocket is folded up and hence does not surround the bottle, whereas in the immersed position it is applied perfectly against the periphery of said bottle.

Furthermore, according to a preferred embodiment in accordance with the invention making it possible to displace the pocket within the chilling liquid, it is also possible to associate it with means making it possible to program the immersion time, and hence the cooling. According to this preferred embodiment, the means for displacing the pocket consist of a set of slide rails along which slides a support arranged beneath the lower surface of the pocket. This support can be associated with a float, the product being placed inside the chilling chamber by means of a downward pressure, and the raising after being held down for a specified period taking place independently, simply by the Archimedes principle. According to a preferred alternative form, one of these slide rails is in the form of a threaded rod passing inside a bearing in the form of a nut associated with the support, the driving of the rod in rotation via an electric geared motor making it possible to lower and raise said support in a positive manner.

BRIEF DESCRIPTION OF THE INVENTION

The invention and the advantages which it provides will, however, be better understood from the concrete illustrative embodiment given below as a guide and with no limitation being implied, and which is illustrated by the attached diagrams, in which.

DETAILED DESCRIPTION OF THE PREFERRED EMBODIMENT

Figure 2:
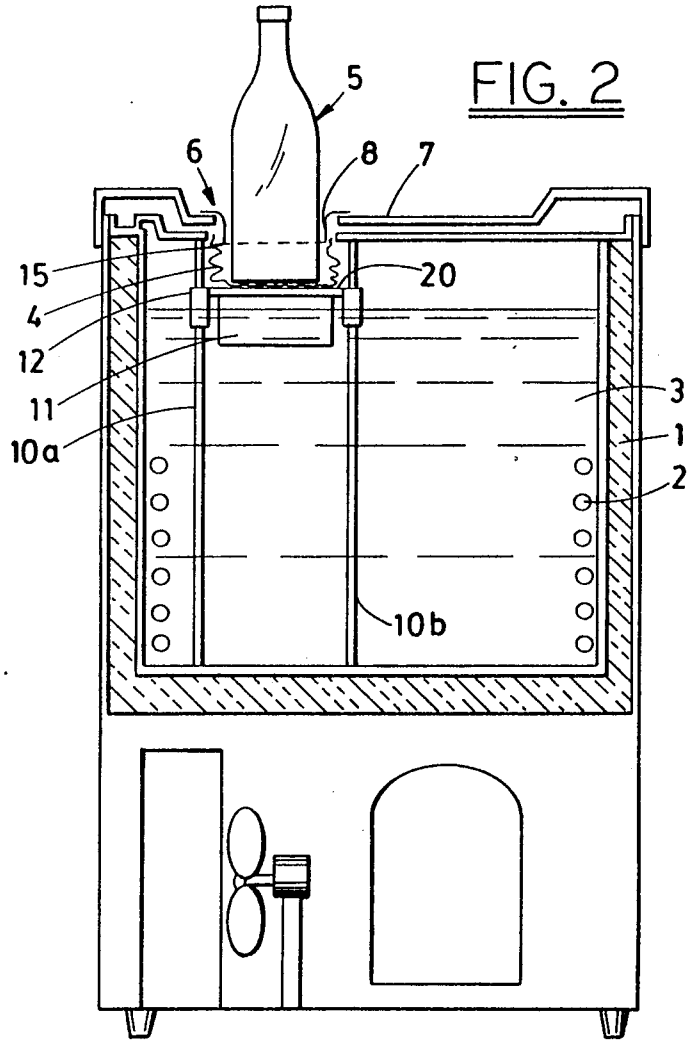
FIGS. 1 and 2 are diagrammatic views in section and in elevation of the whole of an installation according to the invention showing, on the one hand, the bottle in the cooling position (FIG. 1) and, on the other hand, the position of the bottle during its placing or its removal (FIG. 2)
Figure 1:
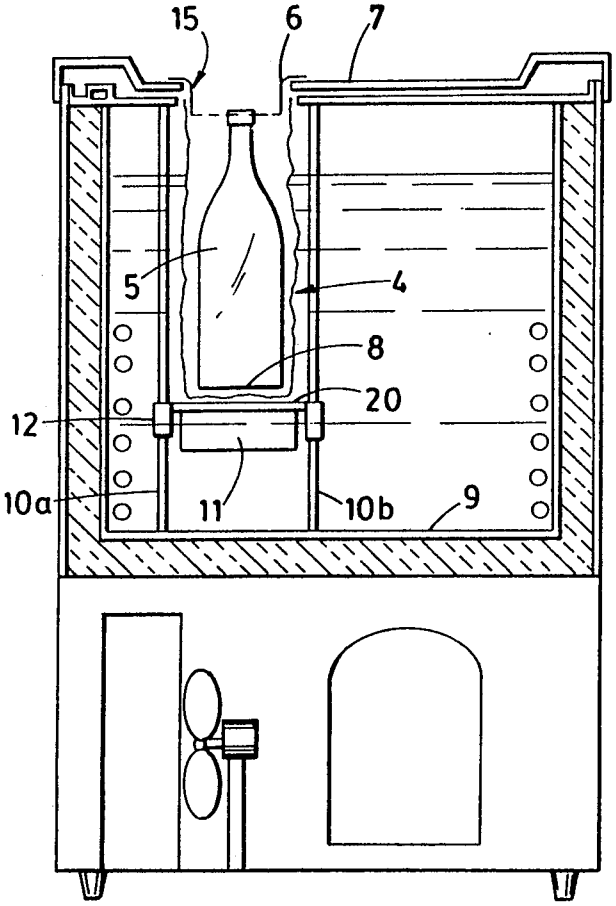

If reference is made to the attached diagrams, and more particularly to FIGS. 1 and 2, the installation according to the invention consists of a temperature-constant tank (1) equipped with a chilling circuit (2) maintaining at a very low temperature a liquid (3) consisting of an unfreezable solution such as, for example, a brine. Inside this tank (1) there are arranged pockets (only one being shown for the sake of simplicity); designated by the general reference (4) and which are intended to receive bottles (5) to be cooled. According to the invention, said pockets (4) consist of a film of leak-tight plastic material such as, for example, a film of polyethylene, the open upper part (6) of which is fixed to a cover (7). Said pockets (4) are associated with means making it possible either to bring their base (8) nearer to the opening (6) (FIG. 2) or, on the contrary (FIG. 1), to unfold the pocket (4) inside the chamber in order to bring the base (8) nearer the bottom (9) of said chamber.

Figure 3:
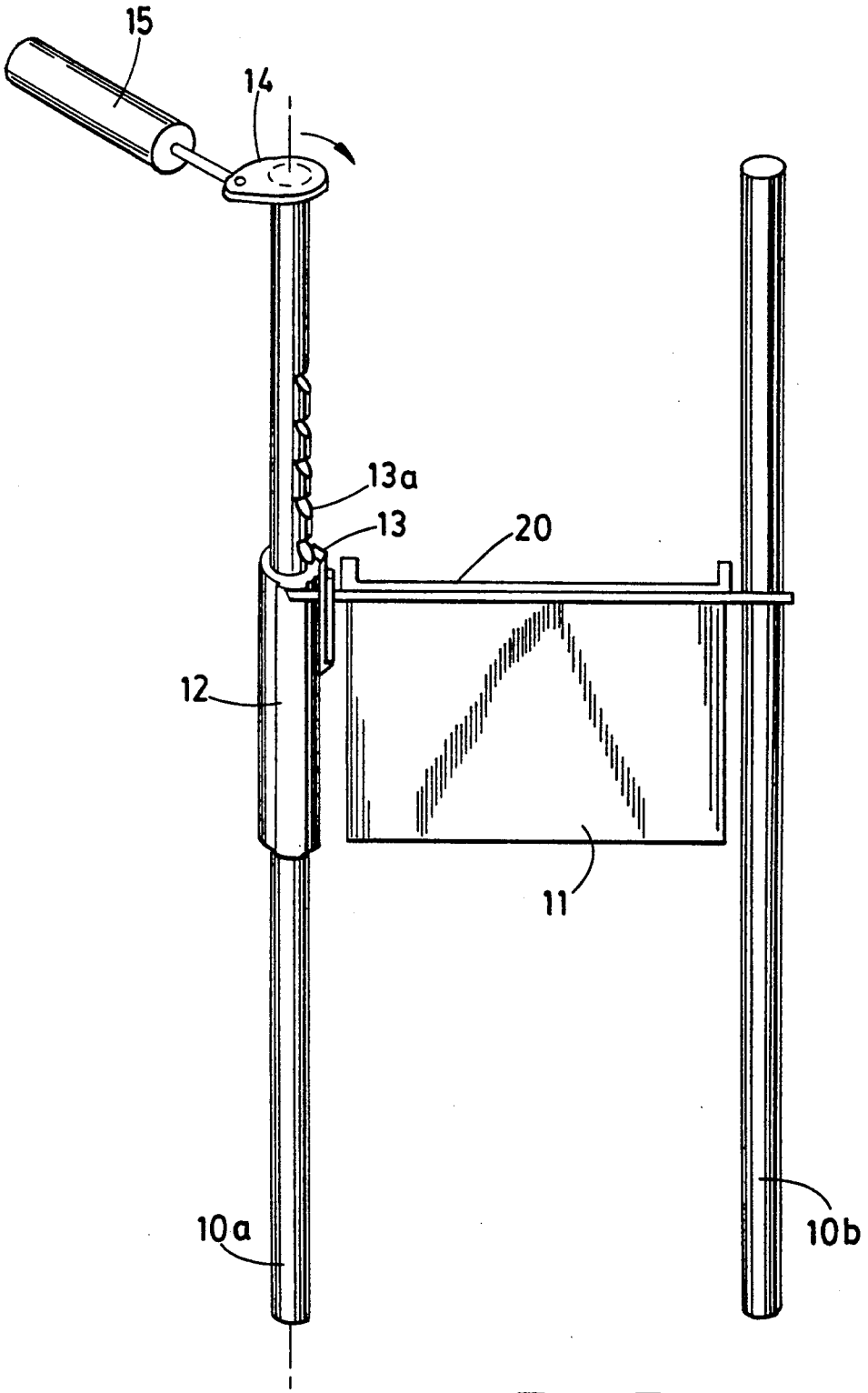
FIG. 3 is a diagrammatic view in elevation of an embodiment of the system associated with the holding pocket and which enables it to be unfolded and raised inside the chilling chamber.

In the embodiment illustrated in FIGS. 1 to 3, the assemblies termed "introduction systems" consist of two rods (10*a*, 10*b*) (see FIG. 3) serving as slide rails and on which can slide a float (11) mounted beneath a support (20) arranged beneath the base (8) of the pocket (4). The side of the opening (6) of the pocket (5) is preferably made fast with the cover (7) by means of a flange (15) so that the upper part of said pocket does not dip into the cooling liquid (3) when the bottle (5) is immersed. In the embodiment illustrated in FIGS. 1 to 3, the support (20) is provided with a float (11) and can slide along the two rods or slide rails (10*a*, 10*b*). One of the bearings ((12) in the present case) which the support (20) and the rod or slide rail (10*a*) associated therewith comprise is designed in such a way as to be able to ensure the locking of the assembly inside the chamber and its unlocking when it is desired to extract the bottle. Such a system can consist, as is illustrated in FIG. 3, of a catch (13) which can fit into notches (13*a*) along the rod (10*a*). The locking (and unlocking) is obtained by causing rotation of the rod (10*a*) via a mechanical means (14) (cam) actuated by an electromagnet system or an electric motor (15).

By virtue of such an assembly, when the bottle is introduced (FIG. 2) followed by pressure on the latter, the float (11)+bottle (5) assembly therefore sinks into the chilling liquid (3). The plastic pocket (4) therefore unfolds and surrounds the bottle and not only protects it but is also applied perfectly against its periphery. When the bottle is completely immersed, the locking system (13) keeps the float (11) completely immersed. The bottle (5) is kept immersed by the plastic bag or pocket, the bottom of which is connected to the float (11). The immersion time, and hence the cooling, can be controlled by a time-delay relay. When the time selected has passed, the time-delay relay actuates the locking system (13) by rotation of the rod (10*a*), controlled by the system (14) moved by the motor (15) temporarily supplied by the time-delay relay. The slide rail (12) is then disconnected from the rod (10*a*) and, simply by the Archimedes principle, tends to rise to the surface of the cooling liquid (3). The bottle consequently automatically rises into the upper position (FIG. 2), is no longer immersed in the cooling liquid (3) and its cooling is stopped. The mechanical system (14) controlled by the motor (15) resumes its initial position, and the locking system (13) is locked again for a second introduction.

The volume of the float and its properties will, of course, be a function of its nature, and of the density of the chilling liquid. This float will be designed in such a way that when it is freed, it can overcome the weight of the bottle (or the like) to be removed from the immersion.

Figure 4:
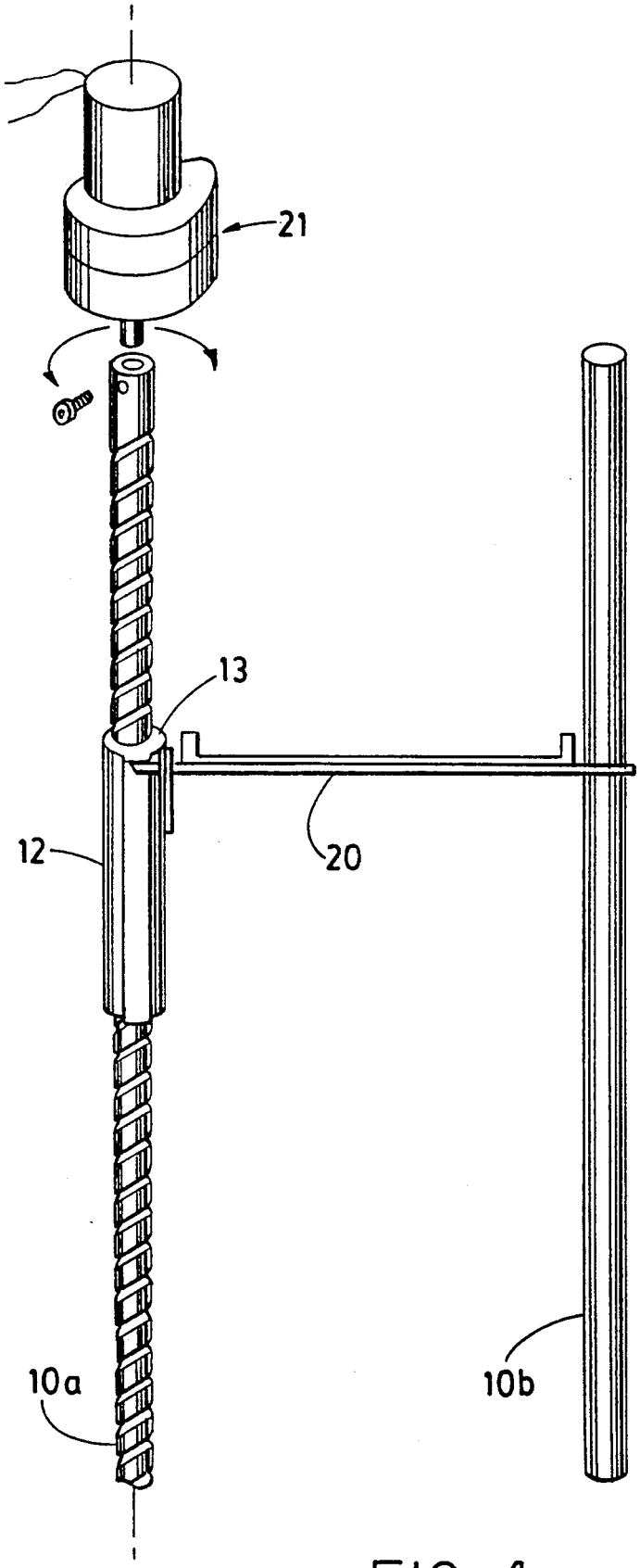
FIG. 4 illustrates another embodiment of a system associated with the holding pocket enabling it to be unfolded inside the chamber and to be raised after a specified period.

FIG. 4 illustrates another embodiment of a system making it possible to introduce the product into, and remove it from, the chamber. As compared with the embodiment described above, the introduction (or removal) of the product is likewise obtained by means of an assembly comprising two rods (10*a*, 10*b*) serving as slide rails, on which can be displaced a support (20) arranged beneath the base (8) of the pocket (4). In this embodiment, the displacements of the support (20) along the two rods (10*a*, 10*b*) are controlled in accordance with the screw/nut principle. One of the rods (10*a*) is in the form of a threaded rod and can be driven in rotation via an electric geared motor (21) with two directions of operation. The bearing (12) associated with the support plate (20) for its part has the shape of a nut. Such an assembly therefore makes it possible to lower and raise the support plate (20) in a positive manner. Moreover, as above, the immersion time inside the chamber can be programed, for example via a printed circuit board controlling the action of the geared motor (21).

Such an assembly of a particularly simple design not only facilitates the operations of introducing a bottle into the chilling liquid, holding it therein and removing it therefrom, but also has a very high degree of efficiency by virtue of the fact that since the pocket is made from a flexible material, it matches perfectly the periphery of the container (bottle) containing the product to be cooled.

I claim:

1. Apparatus for rapidly chilling products stored in containers that comprises:

insulated tank means containing a liquid chilling medium, said tank means having a top cover and a floor;

chilling means for maintaining the liquid at a desired temperature level;

at least one collapsible pocket formed of flexible leak-proof plastic film for individually holding a container of said products to be cooled by immersion in said chilling medium;

said pocket having a horizontally disposed base and collapsible side wall means so that the container to be chilled may be seated on said base in an upright position, said side wall means having an upper mouth that is secured to the top cover of the tank means to hold the pocket in an open condition;

guide means operatively connected to said horizontally disposed base to move said base to a first raised "collapsed pocket" position above the level of liquid chilling medium and to a second lowered "extended pocket" position in said chilling medium with said base adjacent the floor of said tank means; wherein said guide means includes a set of vertically disposed rails and support means mounted beneath the base of the pocket and that is slidably mounted upon the rails;

float means attached to said support means, said float means having sufficient buoyancy to raise the base of the pocket and a container seated thereon from said second lowered position to said first raised position; and programmable means for selectively positioning said base in said second lowered position for a predetermined period of time, including latch means for holding said base in said second position and means for releasing said latch means so that the float means is permitted to raise the base from said second position;

whereby a container seated on said base of said at least one collapsible pocket lowered into thermal communication with said liquid chilling medium is automatically ejected therefrom after passage of said predetermined amount of time.

2. The apparatus of claim 1 that further includes a drive means associated with said guide means for moving the base between said first and second positions.

3. The apparatus of claim 2 wherein said drive means includes a male thread formed on one of said rails that mates with a female thread in the support means and means to turn said threaded rail.

4. The apparatus of claim 1 that further includes programmable means for actuating the release means.

5. The apparatus of claim 1 that further include a plurality of pockets secured to the top cover of said tank.

* * * * *